United States Patent [19]

Kruesi

[11] 4,118,200

[45] Oct. 3, 1978

[54] PROCESS FOR DESULFURIZING COAL

[75] Inventor: Paul R. Kruesi, Golden, Colo.

[73] Assignee: Cato Research Corporation, Wheatridge, Colo.

[21] Appl. No.: 813,801

[22] Filed: Jul. 8, 1977

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 887,145 | 5/1908 | Stoner | 201/17 |
| 1,502,592 | 7/1924 | Sauer | 201/17 |
| 3,166,483 | 1/1965 | Masciantonio | 201/17 X |
| 3,226,316 | 12/1965 | Metrailer et al. | 201/17 X |
| 3,779,722 | 12/1973 | Tatum | **44/1 R** |
| 3,878,051 | 4/1975 | Long et al. | **201/17** |
| 3,909,213 | 9/1975 | Sanders | **44/1 R** |
| 3,998,604 | 12/1976 | Hinkley | **44/1 R** |

*Primary Examiner*—Carl F. Dees

*Attorney, Agent, or Firm*—Sheridan, Ross, Fields & McIntosh

[57] ABSTRACT

The desulfurization of both inorganic and organic sulfur constituents of coal by treating the coal in a liquid fused salt bath in the presence of chlorine to react the sulfur containing constituents with chlorine to form chlorides and elemental sulfur. The liquid fused salt bath is comprised of the chlorides of ferric iron, alkali metals, alkaline earth metals, ammonia, and zinc.

15 Claims, No Drawings

PROCESS FOR DESULFURIZING COAL

BACKGROUND OF THE INVENTION

1. Field of the Invention

The invention lies in the field of coal desulfurization.

2. Prior Art

While the United States has very large known deposits of coal, many of these deposits are not now mined and the coal utilized because its content of sulfur is so high that when the coal is burned the excessive sulfur dioxide released to the atmosphere is far above permissible environmental standards. As a result, expensive transportation costs are incurred in shipping low sulfur content foreign coal into the eastern United States and shipping low sulfur content coal from the western United States to the eastern United States. The Coal existing in the eastern United States has such a high sulfur content that its use is substantially prohibited by environmental standards without desulfurization. Low sulfur content foreign oil is being imported into the United States in huge quantities as a source of energy which could otherwise be met if low sulfur content coal were readily available. The availability of an economically feasible process for substantially diminishing the sulfur content of the abundant high sulfur coals in the United States would have tremendous beneficial effect in decreasing this country's dependency on foreign oil and in decreasing the cost of coal for use by utilities in generating power. Obviously, the development of such a process is now the subject of an extensive and widespread research effort.

Two approaches to reducing the high sulfur content of domestic coals have been taken. One has been to provide large and expensive scrubbers to collect the sulfur dioxide from the stack gases following combustion. Such scrubbers are both expensive to build and to operate, and the sludges collected can create water pollution problems.

The second approach has been the desulfurization to the coal, either by mineral dressing to remove as much as possible of the coal away from pyrite or other inorganic sulfur minerals, or by a chemical attack on the inorganic sulfur and the organic sulfur. This latter approach is exemplified by the process described in *Chemical and Engineering News,* July 7, 1975, called "Battelle Hydrothermal Process". In this process, finely divided coal is treated in an autoclave with sodium hydroxide to react the latter with the pyritic sulfur and a substantial portion of the organic sulfur. While a substantial improvement over earlier processes, this process involves a complex technique to recover sulfur and regenerate reagents and is consequently expensive.

It has been known for some time that chlorine or a chlorine donor such as sulfur monochloride could be effective in chlorinating iron sulfides. In U.S. Pat. No. 2,895,796, C.T. Hill teaches the chlorination of pyrite with chlorine in a liquid sulfur bath. Peters, in U.S. Pat. No. 3,652,219, points out the problems of Hill's process with sulfur viscosity and discloses the chlorination of pyrite in a bath of sulfur monochloride.

Both processes have an inherent problem in that one of the primary reaction products can be ferrous chloride which melts at 670° C. and is little soluble in either sulfur or sulfur monochloride. In coal, where the pyrite occurs in thin seams, the penetration of the lixiviant is prevented and effective desulfurization prevented. Indeed, neither process has been adopted for the removal of pyritic sulfur from coal.

STATEMENT OF THE INVENTION

The sulfur containing constituents contained in coal are reacted in a liquid fused salt bath with chlorine to produce chlorine compounds and elemental sulfur, which latter is readily removed. The liquid fused salt bath is made of mixtures of the chlorides of the alkali metals, alkaline earth metals, zinc, ammonia and ferric iron. The chlorinating agent is chlorine, either supplied as elemental chlorine or supplied by a chlorine donor, such as ferric chloride, sulfur monochloride and cupric chloride. Both organic and inorganic sulfur are effectively removed by the process. In operation, the sulfur containing coal, ground to a fineness which presents a reasonable suface area for reaction with the chlorinating agent, is injected into the low melting point liquid fused salt bath in the presence of chlorine, and the reaction allowed to go substantially to completion. The desulfurized coal can be separated from the liquid fused salts by means well known in the art, such as filtration.

DESCRIPTION OF THE PREFERRED EMBODIMENTS OF THE INVENTION

The process is based on the reaction of pyrite and the organic sulfur-containing compounds present in the coal with chlorine to form chlorine compounds and elemental sulfur. In the case of pyrite, the chloride formed is ferrous chloride. Above about 500° C., most coals begin to decompose into volatile organic compounds and a carbon char. It is therefore preferrable to perform the desulfurization process below the decomposition temperature of coal; however, depending upon the final product desired, for example, a desulfurized char, the process may be performed above this temperature. A minimum temperature of about 300° C. is preferred. Ferrous chloride melts at 670° C., a temperature which is prohibitive for converting pyrite into coal, but it has been found that at 420° C. it is soluble to about 35 mole percent in certain liquid fused salt baths; for example, ferric chloride and sodium chloride. Accordingly, by use of a liquid fused salt bath mixture, which will maintain ferrous chloride in liquid state below 450° C., it has been found possible to effectively convert pyrite to ferrous chloride and elemental sulfur.

It has been found that the reaction proceeds slowly at temperatures below 350° C., but when this temperature is reached it proceeds rapidly. The minimum temperature is that consistent with the salt composition being used in the liquid salt bath. The preferred temperature range is 350°–450° C., with the most preferred range being 380°–420° C. Surprisingly, the chlorination process is effective in removing organic sulfur. This problem has been almost insurmountable by prior art processes. The exact reaction with occurs between chlorine and the organic sulfur-containing compounds in coal is not known at this time. The reaction between pyrite and chlorine which occurs in the chlorination step in the fused salt bath is as follows:

$$FeS_2 + Cl_2 \rightarrow FeCl_2 + 2S^\circ$$

The reaction between pyrite and ferric chloride, which occurs in the chlorination when ferric chloride is used as the chlorine donor, is as follows:

$$FeS_2 + 2FeCl_3 \rightarrow 3FeCl_2 + 2S^\circ$$

The amount of pyrite which can be reacted can be increased by injecting chlorine to react in accordance with the following reaction:

$$2FeCl_2 + Cl_2 \rightarrow 2FeCl_3$$

The salts, which can be used for the liquid fused salt bath mixture, are the chlorides of the alkali metals, alkaline earth metals, zinc, ferric iron and ammonia. Illustrative of these salts are the chlorides of sodium, potassium lithium, barium, calcium, zinc, ferric chloride, and ammonium chloride.

A large number of liquid fused salt bath mixtures are suitable. Sodium chloride and ferric chloride form a liquid fused salt bath system. At about 48 mole percent sodium chloride the melting temperature at which the bath is liquid is as low as 156° C. Ferrous chloride forms with ferric chloride and sodium chloride a ternary liquid fused salt bath system in which ferrous chloride has increasing solubility with increasing temperature. At 420° C. about 35 mole percent ferrous chloride is liquid. Similarly, zinc chloride forms a liquid fused salt bath with sodium chloride. At about 45 mole percent zinc chloride the melting temperature is 262° C. Ferrous chloride, zinc chloride and sodium chloride form a liquid fused salt bath ternary system at 400° C. A large number of other salt combinations are possible and practical. The essential requirements are that the fused salt bath mixtures be liquid at the operating temperature chosen and that ferrous chloride be soluble in the bath in reasonable amounts at this temperature.

An ammonium chloride/ferric chloride liquid fused salt bath is preferred because of its low cost and the ease of removing residual ammonium chloride and ferric chloride from the coal. At temperatures above 400° C. the chlorides are volatile. It is further desirable to have ferric chloride in the liquid fused bath mixture and as a chlorine donor. The other chloride salts used in the mixture do not take part in the chlorination reaction.

Chlorine is the chlorinating agent and may be introduced as such as supplied by a chlorine donor, such as ferric chloride, sulfur chloride and cupric chloride into the reaction mixture.

As to the sulfur recovery problem, at temperatures less than 400° C., but above the melting point of sulfur (120° C.), the sulfur will be found as a molten pool floating on the liquid fused salt bath from which it can be readily separated. At temperatures near 440° C., the boiling point of sulfur, the sulfur is readily volatilized and can be easily condensed to a liquid without escape to the atmosphere.

The desulfurized coal is separated from the liquid fused salt bath by means well known in the art, such as filtration. The coal may then be washed with fused ferric chloride or ammonium chloride to remove all traces of other salts. The residual ferric chloride and ammonium chloride may then be volatilized from the coal and recovered for reuse in the fused salt bath. Alternatively, the filtered coal with minor amounts of adherent salts may be washed in hot water to remove the salts. Upon completion of either procedure the desulfurized coal is ready for market.

The salts for the fused bath may be so selected that their liquid specific gravity is more than that of coal but less than that of common mineral impurities in the coal so that the desulfurized coal will float upon the top of the fused salt mixture where it can be removed and the mineral impurities sink to the bottom of the fused salt bath from which they may be removed. For example, a liquid fused salt bath of ferric chloride and ammonium chloride can be made having a specific gravity of about 2–2.5, well above the specific gravity of coal. The ordinary impurities found in coal in significant amounts are shale, quartz and pyrite, with specific gravity of 2.6 for quartz, 5 for pyrite and about 2.6 for shale. The specific gravity of coal is $\sim 1.3$.

The iron recovered from the pyrite as ferrous chloride is recovered as ferric oxide in accordance with the following reaction:

$$6FeCl_2 + 1.5\ O_2 \rightarrow Fe_2O_3 + 4FeCl_3$$

The ferric chloride can be reused in the salt bath. Alternatively, the ferrous chloride can be oxidized to ferric chloride as is well known, for use in the fused salt bath.

The operation of the invention is illustrated by the examples which follow and is not limited to scope by the examples.

The amount of grinding of the coal prior to the chlorination reaction is not critical but depends upon the nature of the coal, its proposed end use, and the degree of desulfurization desired. It is desirable for ease of handling to grind the coal to at least −14 mesh. Additional grinding will improve the desulfurization by providing more surface area for reaction but will result in a more difficult solids separation and will be more expensive.

EXAMPLE 1

36 grams of crushed coal from the Lower Freeport Seam was analyzed and found to contain 2.74 percent sulfur, of which 2.05 percent was inorganic and 0.69 percent was organic. The coal was fed with nitrogen gas to a reaction liquid fused salt bath of 207 grams ferric chloride, 93 grams sodium chloride at a temperature of 430° C. Chlorine was bubbled through the reaction mass. After reacting for about 30 minutes the mass was allowed to cool and the salts dissolved in water. The residual coal assayed 0.22 percent organic sulfur (68 percent has been removed) and 0.53 percent inorganic sulfur (74 percent was removed).

EXAMPLE 2

A sample of 34 grams of Pittsburgh Seam Coal crushed to −14 mesh assayed 3.07 total sulfur of which 0.66 percent was organic and 2.41 percent was inorganic. This was reacted with chlorine at 430° C. in 300 grams of a liquid fused salt bath of ferric chloride/-sodium chloride. Chlorine was bubbled into the reaction mass. After washing, the residual coal assayed 0.34 percent organic sulfur (48 percent removed) and 0.74 percent inorganic sulfur (69 percent removed).

EXAMPLE 3

A similar reaction as in Examples 1 and 2, using the same liquid fused salt bath, was run with a Utah Seam Coal, which before reaction analyzed 0.59 organic sulfur and 0.99 inorganic sulfur. These were reduced to 0.21 organic sulfur (63 percent reduction) and 0.43 inorganic sulfur (57 percent reduction).

EXAMPLE 4

A liquid fused salt bath of 200 grams of ferric chloride and 93 grams of sodium chloride melting at 430° C. was made. To the bath was added 37 grams of Illinois Seam Number 6 coal ground to −14 mesh. Chlorine was bubbled through the reaction liquid mass. The coal before treatment assayed 2.48 percent inorganic sulfur plus 2.31 percent organic sulfur. After treatment the coal assayed 0.56 inorganic sulfur and 1.61 percent organic sulfur showing that 77 percent of the inorganic sulfur and 33 percent of the organic sulfur had been removed.

EXAMPLE 5

A liquid fused salt bath of 400 grams of zinc chloride-potassium chloride mixture melting at 420° C. was made. To the bath was added 30 grams of Illinois Seam Number 6 coal ground to −14 mesh. Chlorine was fed to the bath alternatively to the feeding of the coal. After the reaction was completed the coal was found to contain 1.33 percent inorganic sulfur (46 percent reduction) and the same amount of organic sulfur as was initially contained in the coal. This shows that the attack of the pyritic sulfur is effective as long as a solvent for the ferrous chloride formed is present.

EXAMPLE 6

600 grams of a liquid fused bath ferric chloride-sodium chloride mixture melting at 430° C. was made. To the bath was added 22 grams of Illinois Number 6 coal ground to −14 mesh. No chlorine was added, the ferric chloride alone serving as a chloride donor. Assay of the coal after reaction showed only 0.4 percent of inorganic sulfur remaining (84 percent removal) and 1.53 percent or organic sulfur remaining (34 percent removal) showing the effectiveness of ferric chloride as a chlorine donor.

EXAMPLE 7

A liquid fused salt bath of 84 grams of ammonium chloride and 316 grams of ferric chloride was made at a temperature of 330° C. To the bath was added 30 grams of Illinois Seam Number 6 coal, followed by bubbling 39 gram of chlorine into the liquid fused salt bath mixture. The reaction was allowed to go to completion. Analysis showed that the sample contained 2.48 percent inorganic sulfur and after desulfurization contained 1.14 percent inorganic sulfur. The sample contained 2.31 percent organic sulfur before desulfurization and 2.00 percent organic sulfur after desulfurization, indicating a 54.0 percent removal of inorganic sulfur and 13.42 percent removal of organic sulfur. The low percentage removal of organic sulfur, as compared to the other examples, is due to the lower temperature used of 330° C.

It is seen from the above examples that the chlorination proceeded substantially to completion proving that no initial soluble high melting point chlorides were formed to occlude the sulfur containing constitutents of the coal so that they would not be reacted with the chlorine. The invention makes possible the conversion of the pyrite to elemental sulfur and an ordinarily high melting point ferrous chloride which melts in the liquid fused salt bath at temperatures below the volatilization point of coal, thus making possible the removal of sulfur from the coal by the chlorination route. Organic sulfur is also effectively removed. A further advantage of the invention stemming from its low chlorination temperature is that it can be performed in glass containers or glass-lined containers, the softening point of glass being about 500° C.

What is claimed is:

1. A process for desulfurizing coal which comprises:

(a) forming a liquid fused salt bath melting below the decomposition temperature of coal comprised of chlorides selected from the group consisting of chlorides of alkali metals, alkaline earth metals, ammonia, ferric iron, and zinc;

(b) introducing the coal into said liquid fused salt bath;

(c) introducing into said fused salt bath chlorine from a source selected from the group consisting of elemental chlorine, and a chlorine donor selected from the group consisting of sulfur chloride, ferric chloride and cupric chloride to react the sulfur-containing components of the coal with chlorine to form elemental sulfur and chlorides; and (d) recovering the desulfurized coal from the liquid fused salt bath.

2. The process of claim 1 performed at a temperature below about 500° C.

3. The process of claim 1 performed at a temperature below about 350° C.–450° C.

4. The process of claim 1 in which chlorine is introduced as elemental chlorine.

5. The process of claim 1 in which said chlorine donor is ferric chloride.

6. The process of claim 1 in which said chlorine donor is sulfur chloride.

7. The process of claim 1 in which the salts of the liquid fused salt bath comprise ferric chloride and sodium chloride.

8. The process of claim 7 in which ammonium chloride is added as one of the salts of the liquid fused bath.

9. The process of claim 1 in which the salts of the liquid fused bath comprise ferric chloride and ammonium chloride.

10. The process of claim 1 in which the salts of the liquid fused bath comprise ammonium chloride and sodium chloride.

11. The process of claim 1 in which the salts of the liquid fused bath comprise zinc chloride and potassium chloride.

12. The process of claim 1 in which inorganic sulfur is removed from the coal.

13. The process of claim 1 in which organic sulfur is removed from the coal.

14. The process of claim 1 in which the desulfurized coal is recovered by distillation.

15. The process of claim 1 in which the salts of the fused bath are so selected that the specific gravity of the liquid fused salt bath they form is greater than the desulfurized coal and less than that of any of the common impurity materials found in coal.

* * * * *